US011330850B2

(12) United States Patent
Yoo

(10) Patent No.: US 11,330,850 B2
(45) **Date of Patent: *May 17, 2022**

(54) MULTI-USE GARMENT

(71) Applicant: Jenny Yoo Collection, Inc., New York, NY (US)

(72) Inventor: Jenny Yoo, New York, NY (US)

(73) Assignee: Jenny Yoo Collection, Inc., New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/915,819

(22) Filed: Jun. 29, 2020

(65) Prior Publication Data

US 2020/0323289 A1 Oct. 15, 2020

Related U.S. Application Data

(63) Continuation of application No. 13/672,422, filed on Nov. 8, 2012, now Pat. No. 10,694,791.

(60) Provisional application No. 61/596,646, filed on Feb. 8, 2012.

(51) Int. Cl.
*A41D 15/00* (2006.01)
*A41D 1/22* (2018.01)

(52) U.S. Cl.
CPC ..... *A41D 1/22* (2013.01); *A41D 15/00* (2013.01); *A41D 15/002* (2013.01)

(58) Field of Classification Search
CPC ..... A41D 15/002; A41D 1/22; A41D 15/00
USPC ..... 2/47, 48, 69.5, 70, 74, 105
See application file for complete search history.

(56) References Cited

U.S. PATENT DOCUMENTS

D131,186 S * 1/1942 Kamholz ..... D2/864
D137,149 S * 1/1944 Walker ..... A41C 3/06 D2/795
D154,621 S * 7/1949 Morgan ..... D2/757
D155,674 S * 10/1949 Adler ..... A41D 1/22 D2/797
D156,130 S * 11/1949 Leavell ..... A41D 1/22 D2/739
2,521,020 A * 9/1950 Prescott ..... A41D 15/00 2/70
4,055,854 A * 11/1977 Jones ..... A41D 7/00 2/105
4,062,062 A * 12/1977 Basaldua ..... A41D 1/22 2/105
4,142,253 A * 3/1979 Roscoe ..... A41D 1/22 2/74
6,883,179 B1 * 4/2005 Crum ..... A41C 3/06 2/105

(Continued)

*Primary Examiner* — Sally Haden
(74) *Attorney, Agent, or Firm* — Byrne Poh LLP

(57) ABSTRACT

A strapless multi-use garment comprises an upper garment portion designed to cover an area above waist of a user having a front portion and a rear portion, a gathered skirt having a front portion and a rear portion attached with the upper garment portion, a waist band attached at a top portion of the gathered skirt, a plurality of front panels attached at the front portion of the gathered skirt, a plurality of rear panels is attached at the rear portion of the gathered skirt and at least one fastening means. The plurality of front panels and the plurality of rear panels, extending downwardly from the waist band, are adaptable for multiple configurations that allow the multi-use garment to be worn in a wide range of stylish designs in different occasions.

20 Claims, 5 Drawing Sheets

(56) References Cited

U.S. PATENT DOCUMENTS

D636,559 S * 4/2011 Maestrales ..... D2/737
D695,492 S * 12/2013 Tarr ..... D2/792

* cited by examiner

MULTI-USE GARMENT

CROSS-REFERENCE TO RELATED APPLICATIONS

This applications is a continuation of U.S. patent application Ser. No. 13/672,422, filed Nov. 8, 2012, which claims the benefit of U.S. Provisional Patent Application No. 61/596,646, filed Feb. 8, 2012, each of which is hereby incorporated by reference herein in its entirety.

STATEMENT REGARDING FEDERALLY SPONSORED RESEARCH AND DEVELOPMENT

Not Applicable.

FIELD OF THE DISCLOSURE

The present disclosure relates generally to garments, and more particularly, to a strapless multi-use garment having a plurality of panels adaptable for multiple configurations that allows the multi-use garment to be worn in a wide range of stylish designs.

DISCUSSION OF RELATED ART

A wide variety of stylish multi-use garments have been developed in the art. The multi-use garments enable a single garment to be worn in different configurations. This is because the multi-use garments can be configured into multiple styles thereby allowing a single dress to be used in different occasions. The multi-use garments remove the burden of storing multiple articles of clothing for different styles and occasions. Usually, multi-use garments are mainly manufactured for women. The multi-use garments can be worn anywhere and converted to other versatile designs. However, conventional multi-use garments have considerable drawbacks. For example, most of the multi-use garments do not possess an aesthetic appearance. Such garments cannot be quickly converted to other designs and require more manipulations for the conversions. Since these garments have different functions, they will be very bulky, have complex construction and be less portable.

Most of the multi-use garments are designed in such a way that they can be styled in a limited number of ways. Also, the multi-use garments available today are not suitable for brides as they are not very attractive. Another drawback for the existing multi-use garments is that they are fabricated in stretch material and have more straps on their shoulder parts. This causes discomfort to the user. Therefore, it would be desirable to provide an improved strapless multi-use garment that do not require extra support to stay on user's body.

U.S. Pat. No. 8,214,923 issued to Lee on Jul. 10, 2012 provides a multi purpose garment that can be worn in a variety of configurations on different parts of the body and for a variety of occasions. The garment includes a first sheet of material and a second sheet of material, which is positioned opposite the first sheet of material. The first and second sheets of material are secured to one another at or near two opposite ends of the sheets of material. The two other opposite ends of the sheets of material are open to allow a part of the body to pass through at least one of the openings. At least one of the open ends has a securing device positioned along at least a portion of the opening that may securely close at least a portion of the respective opening to secure the garment about the person. However, the multi-purpose garment does not provide aesthetic appearance.

Similarly, as taught in U.S. Pat. No. 4,142,253 issued to Roscoe on Mar. 6, 1979 provides a multi-purpose or multi-functional and multi-style garment which has a generally tubular structure or configuration, having in the upper section thereof at least two integral tie sections, the locus of the profiles of the tie sections being of generally triangular configuration and the length of the tie sections being greater than the radius of the tubular structure, whereby the garment is adapted to multiple functions and styles and modular coordination with accessories. A garment of this invention can be made from a tubular blank, a planar blank folded upon itself, or from a flat unfolded piece of textile material. The tie sections integrated to the multi-purpose garment provide discomfort to the user.

In addition, U.S. Pat. No. 20090300817 issued to Fata on Dec. 10, 2009 describes a multi-use and multi-style garment is shown from a single piece of fabric, having a tubular main portion having both anterior and posterior edges when viewed in elevation, the tubular main portion being adapted to surround desired portions of the body of the wearer; can be manipulated in different ways depending on both the desired type and style of clothing; a vertical slit extending downwardly on the anterior edge of at least one side of the tubular main portion to allow for mobility when the garment is worn by the wearer; the shorter the garment to the point of substantially being a blouse, and the longer the diameter the longer the garment to the point of substantially being a dress; when the opposing extensions are not crisscrossed and tied around the waist of the wearer, the garment is substantially a skirt. The multi purpose garment does not provide aesthetic appearance and it is not versatile for usage in different occasions.

Therefore, there is a need for a simple, stylish and aesthetic multi-use garment. Such a needed multi-use garment would be quickly converted to other designs. Such a device would be lightweight and portable. Moreover, the needed device would possess an attractive appearance and would be suitable for brides. Further, the needed device would be converted into a large number of versatile stylish designs and be strapless. Finally, the needed device would be fabricated from fine quality material and would not require additional support to stay on the user's body. The present disclosure accomplishes these objectives.

SUMMARY OF THE DISCLOSURE

The present embodiment provides a strapless multi-use garment. The strapless multi-use garment comprises an upper garment portion, a gathered skirt, a waist portion, a waist band attached at a top portion of the gathered skirt, a plurality of front panels, a plurality of rear panels and at least one fastening means. The upper garment portion has a front portion and a rear portion is designed to cover an area above the waist of a user. The gathered skirt is attached to the upper garment portion and has a front portion and a rear portion. The plurality of front panels is attached at the front portion of the gathered skirt and extends downwards from the waist band. The plurality of rear panels is attached at the rear portion of the gathered skirt and extends downwards from the waist band. At least one of the plurality of front panels and at least one of the plurality of rear panels are adaptable to tie together in a plurality of stylish designs according to user's desire. The at least one fastening means extends downwardly along the rear portion of the upper garment portion and the rear portion of the gathered skirt. The at least one fastening means allows to secure the strapless multi-use garment firmly on the user's body.

The plurality of front panels and the plurality of rear panels are adaptable for multiple configurations (e.g., a first configuration, a second configuration, a third configuration, etc.) that allows the multi-use garment to be worn in a wide range of stylish designs in different occasions. The at least one of the plurality of front panels and the at least one of the plurality of rear panels are lifted at skirt level and/or at the neckline around the shoulders of the user to tie the at least one of the plurality of front panels and the at least one of the plurality of rear panels together. The plurality of front panels and the plurality of rear panels are tied together in different ways that provide multiple stylish appearances to the multi-use garment. The plurality of front panels and the plurality of rear panels are pleated to provide an aesthetic appearance to the multi-use garment. The multi-use garment is built in boning and inner bodice construction for full upper body support. The multi-use garment allows a user to wear the garment in its natural form without any panel manipulation and provides support needed to stay on user's body.

The strapless garment can be quickly converted to other designs and can be used as bridal dress and ball gown. The strapless multi-use garment is available in various sizes and colors. The strapless multi-use garment is fabricated from woven cloth to provide comfort to the user. The strapless multi-use garment has simple construction that makes it lightweight and portable.

DETAILED DESCRIPTION OF THE PREFERRED EMBODIMENT

The following describes example embodiments in which the present invention may be practiced. This invention, however, may be embodied in many different ways, and the description provided herein should not be construed as limiting in any way. Among other things, the following invention may be embodied as methods or devices. As such, the present invention may take the form of an entirely hardware embodiment, an entirely software embodiment, or an embodiment combining software and hardware aspects. The following detailed descriptions should not be taken in a limiting sense.

In this document, the terms "a" or "an" are used, as is common in patent documents, to include one or more than one. In this document, the term "or" is used to refer to a nonexclusive "or," such that "A or B" includes "A but not B," "B but not A," and "A and B," unless otherwise indicated. Furthermore, all publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

Figure 1A:
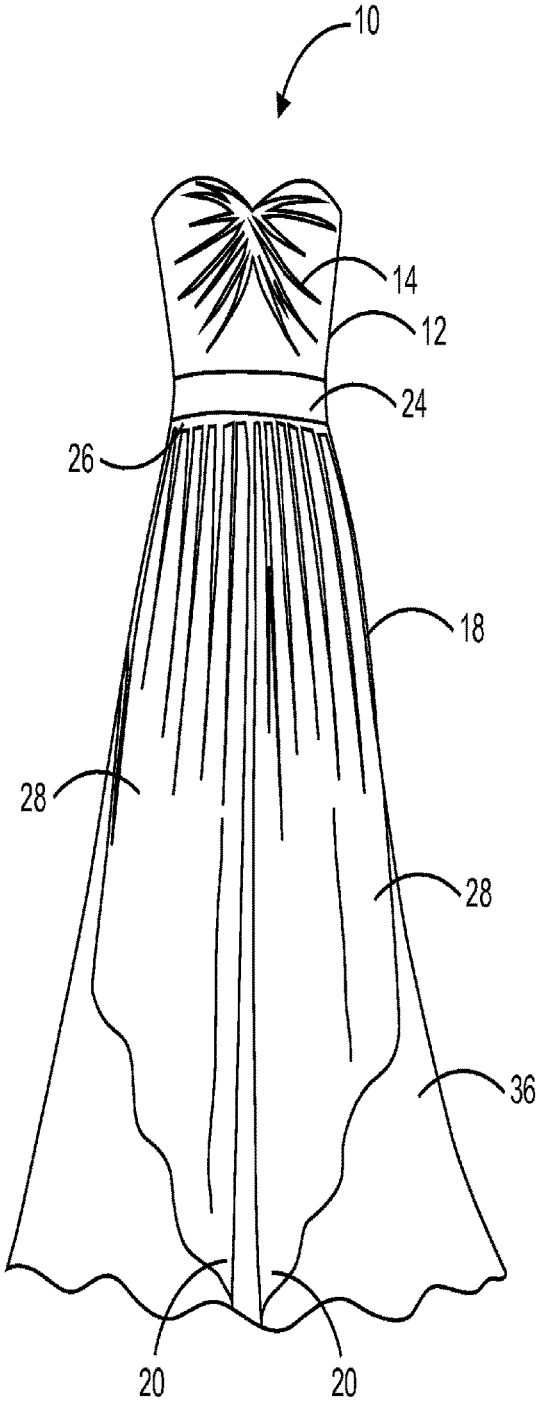
FIG. 1A is a front view of the present embodiment (e.g., in a first configuration), illustrating a front portion of an upper garment portion and a front portion of a gathered skirt of a strapless multi-use garment.

FIG. 1A is a front view of the present embodiment, illustrating a strapless multi-use garment 10. The strapless multi-use garment 10 comprises an upper garment portion 12 covering an area above waist of a user, a gathered skirt 18 attached with the upper garment portion 12, a waist band 24 attached at a top portion 26 of the gathered skirt 18, a plurality of front panels 28, a plurality of rear panels 30 (FIG. 1B) and at least one fastening means 38 (FIG. 1B).

Figure 1B:
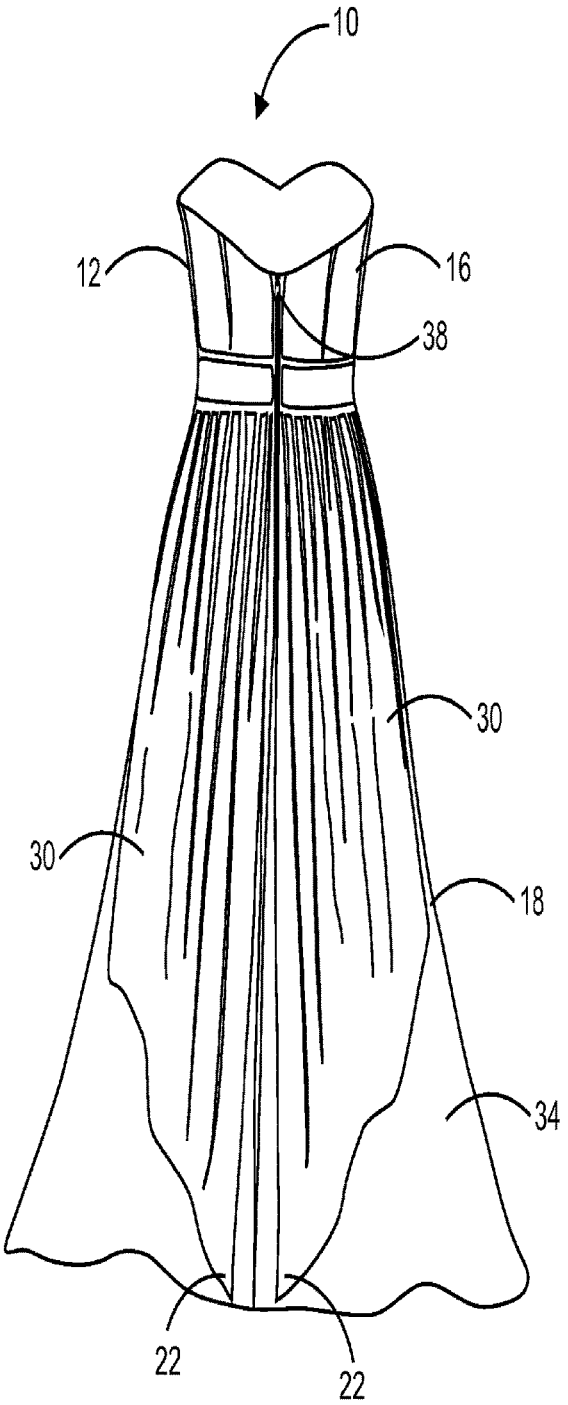
FIG. 1B is a front view of the present embodiment (e.g., in a first configuration), illustrating a rear portion of the upper garment portion and a rear portion of the gathered skirt of the strapless multi-use garment.

The upper garment portion 12 includes a front portion 14 and a rear portion 16 (FIG. 1B). The waist band 24 is designed to surround the waist of the user. The gathered skirt 18 includes a front portion 36 and a rear portion 34 (FIG. 1B). The plurality of front panels 28 and the plurality of rear panels 30 (FIG. 1B) extend downwardly from the waist band 24. The plurality of front panels 28 is attached at the front portion 36 of the gathered skirt 18 and the plurality of rear panels 30 is attached at the rear portion of the gathered skirt 34 (FIG. 1B). The plurality of front panels 28 and the plurality of rear panels 30 (FIG. 1B) are adaptable for multiple configurations that allow the multi-use garment 10 to be worn in a wide range of stylish designs. The multiple configurations of the plurality of front panels 28 and the plurality of rear panels 30 (FIG. 1B) allow the strapless multi-use garment 10 to be worn in different occasions. The multi-use garment 10 is built in boning and inner bodice construction for full upper body support. The plurality of front panels 28 includes a front panel end 20 and the plurality of rear panels 30 includes a rear panel end 22 (FIG. 1B). The front panel end 20 and the rear panel end 22 (FIG. 1B) are not attached with the garment 10. At least one of the plurality of front panels 28 and at least one of the plurality of rear panels 30 are adaptable to tie together in a plurality of stylish designs according to the user's desire.

FIG. 1B is a front view of the present embodiment, illustrating the rear portion of the upper garment portion 16 and the rear portion of the gathered skirt 34 of the strapless multi-use garment 10. The multi-use garment 10 includes at least one fastening means 38 extending downwards along the rear portion of the upper garment portion 16 and the rear portion of the gathered skirt 34 to firmly secure the strapless multi-use garment 10 on the user's body. The at least one fastening means 38 may be a zipper. The strapless multi-use garment 10 has simple construction thereby making the garment 10 lightweight and portable.

Figure 2A:
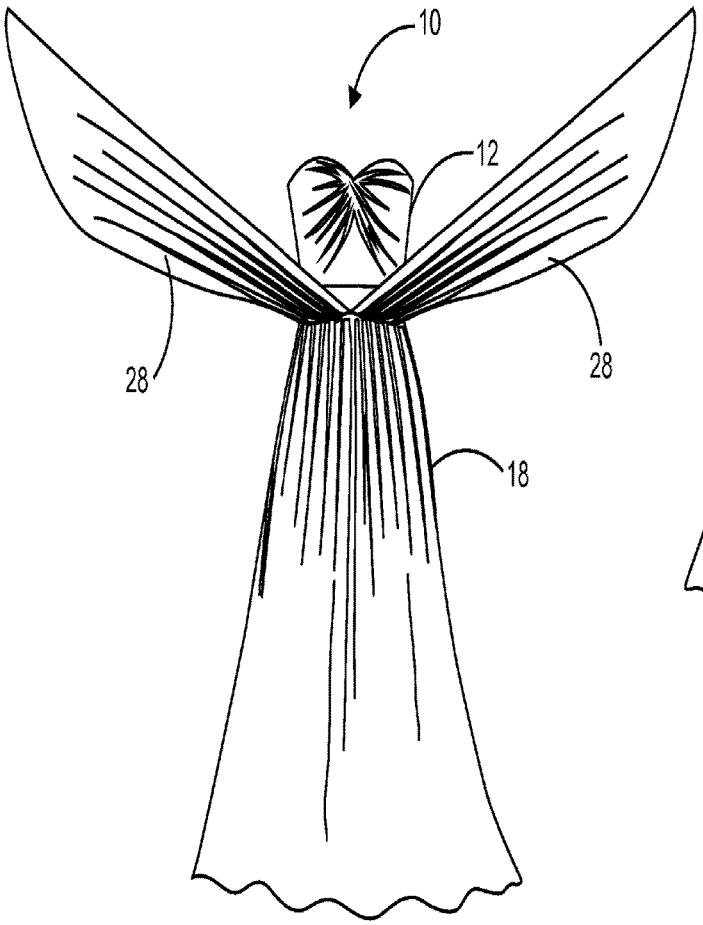
FIG. 2A is a front view of the present embodiment, illustrating a plurality of front panels in a lifted position.
Figure 2B:
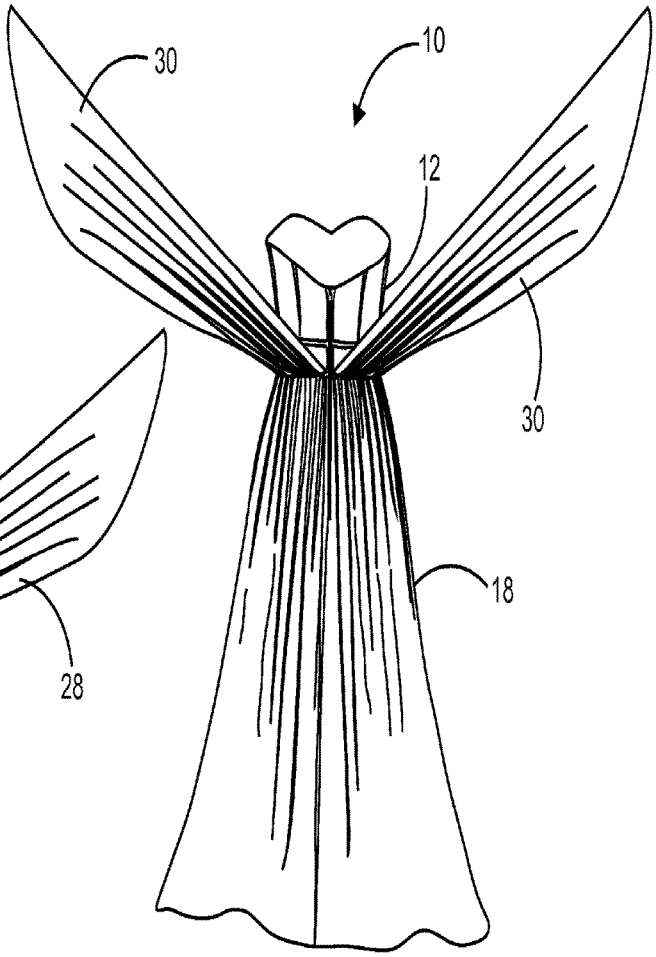
FIG. 2B is a front view of the present embodiment, illustrating the plurality of rear panels in the lifted position.

FIG. 2A illustrates the plurality of front panels 28 in a lifted position. The plurality of front panels 28 is lifted to configure the multi-use garment in different designs. FIG. 2B illustrates the plurality of rear panels 30 in the lifted position. In the preferred embodiment, there are two front panels 28 and two rear panels 30. The plurality of front panels 28 and the plurality of rear panels 30 are pleated to add an aesthetic appearance to the multi-use garment 10. The strapless multi-use garment 10 is available in various sizes and colors.

Figure 3A:
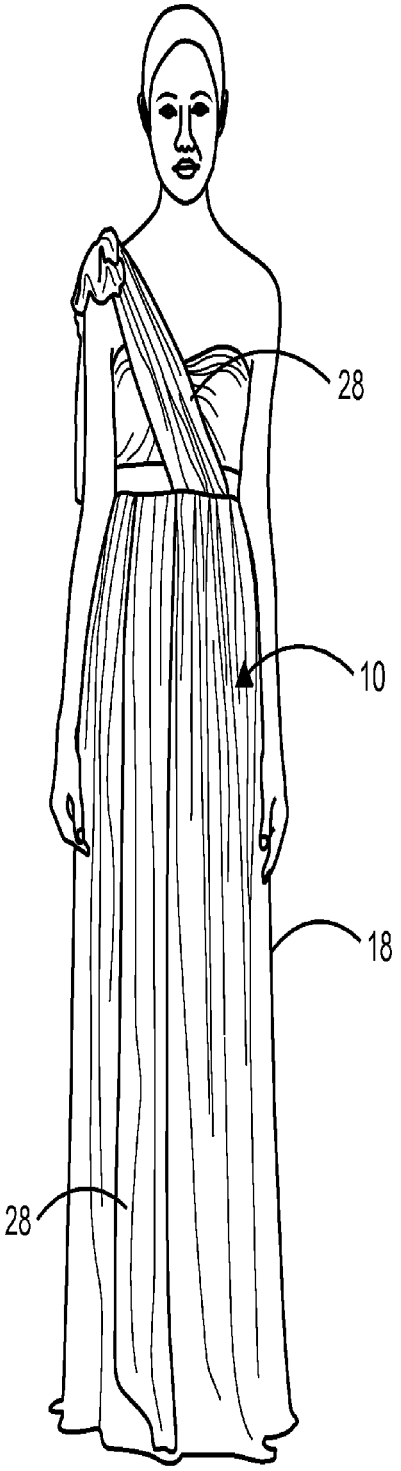
FIGS. 3A-3B illustrate different designs of the multi-use garment by configuring the plurality of front panels and the plurality of rear panels in different fashionable ways (e.g., in a third configuration shown in FIG. 3A)
Figure 3B:
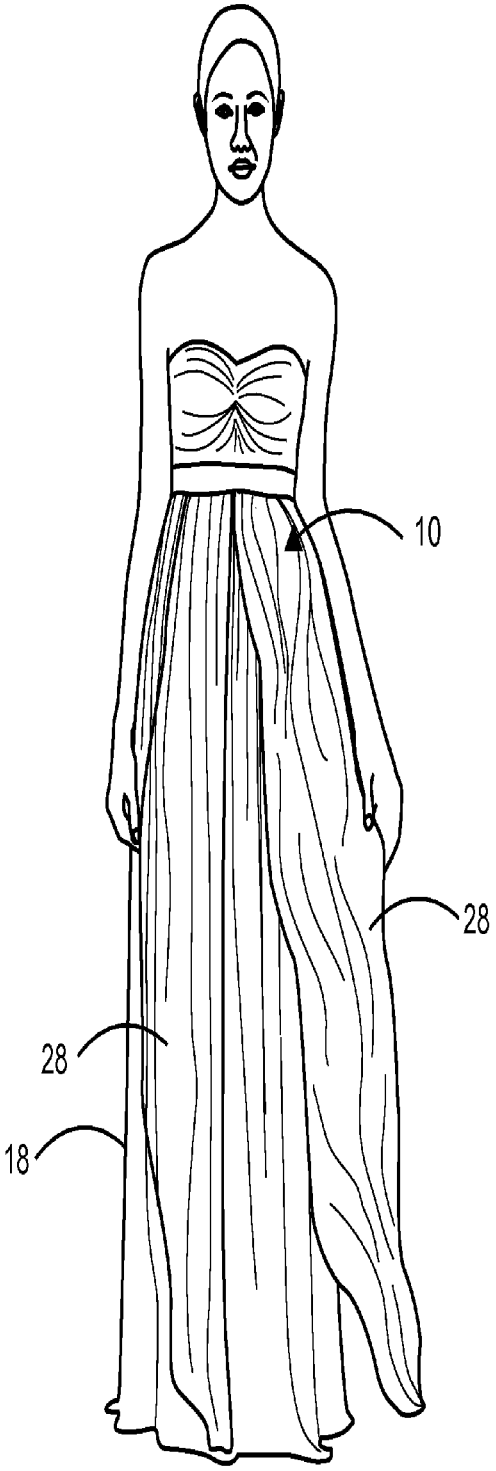

FIGS. 3A-3B illustrate different designs of the multi-use garment 10 by configuring the plurality of front panels 28 and the plurality of rear panels 30 in different fashionable ways. The multi-use garment 10 does not possess any strap thereby allowing a user to wear the garment 10 as a strapless dress in its natural form without any panel manipulation and provides support needed to stay on user's body. Also, the strapless garment 10 can be quickly converted to other designs. The at least one of the plurality of front panels 28 and the at least one of the plurality of rear panels 30 are lifted at skirt level and/or at the neckline around the shoulders of the user to tie the at least one of the plurality of front panels 28 and the at least one of the plurality of rear panels 30 together according to the user's desire. The plurality of front panels 28 and the plurality of rear panels 30 can be tired together in different ways that provide multiple stylish appearances to the multi-use garment 10 as shown in FIG. 3A. The multi-use garment 10 can be used as bridal dress and ball gown. The gathered skirt 18 is very long and features a slight A-line shape. The multi-use garment 10 is fabricated from woven cloth to provide comfort to the user. Preferably, woven cloth like chiffon material is used for its fabrication.

Figure 3C:
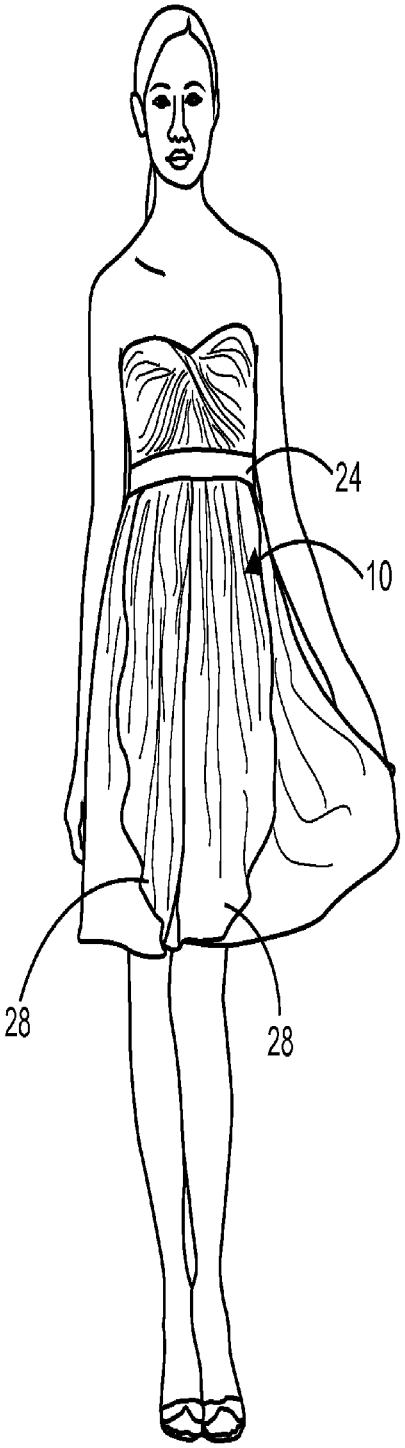
FIGS. 3C-3E illustrate alternate embodiments of different designs of the multi-use garment by configuring the plurality of front panels and the plurality of rear panels in different fashionable ways (e.g., in a third configuration shown in FIG. 3D, in a second configuration shown in FIG. 3E).
Figure 3D:
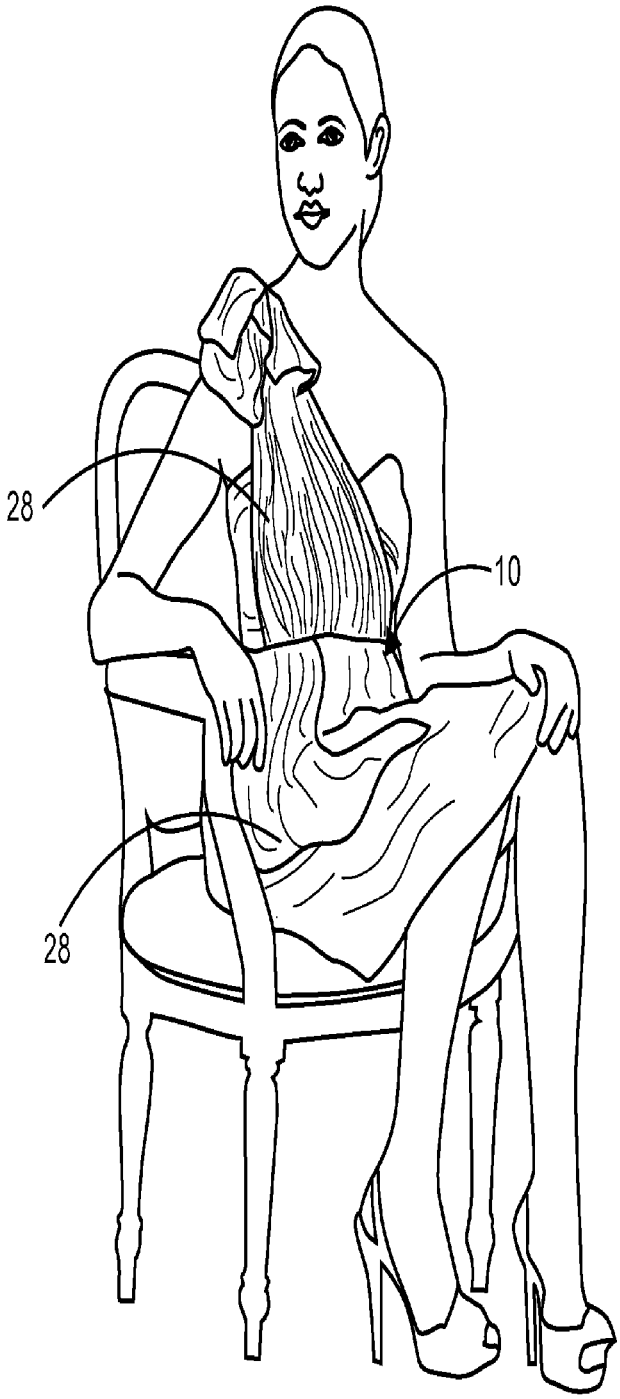
Figure 3E:
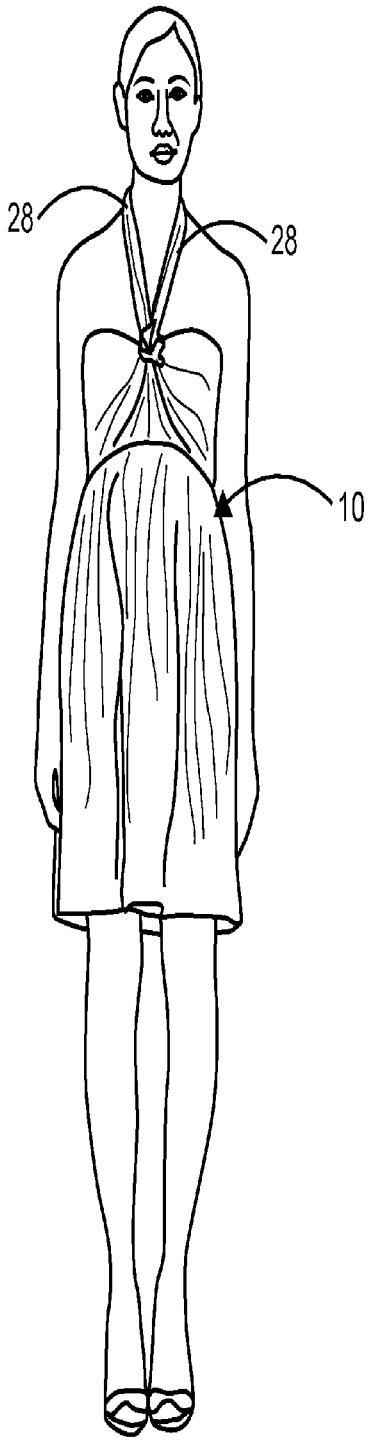

FIGS. 3C-3E illustrate alternate embodiments of different designs of the multi-use garment. The waist band 24 hits just above the natural waist with delicate gathers and the multi-use garment 10 is fully lined. The plurality of front panels 28 and the rear panels 30 create alternate necklines and skirt details. The gathered skirt 18 is designed in such a way that it hits above the user's knee. Referring to FIG. 3D, the at least one of the plurality of front panels 28 and the at least one of the plurality of rear panels 30 are tied together at one of the shoulders of the user. In FIG. 3E, the plurality of front panels 28 and the plurality of rear panels 30 are tied together around the neck of the user.

While a particular form of the invention has been illustrated and described, it will be apparent that various modifications can be made without departing from the spirit and scope of the invention. Accordingly, it is not intended that the invention be limited, except as by the appended claims.

What is claimed is:

1. A multi-use garment, comprising:

a bodice;

a skirt constructed beneath the bodice, the skirt having a front portion and a rear portion; and a plurality of panels including a first plurality of panels and a second plurality of panels, each panel of the plurality of panels having an end and an opposing end, wherein:

the end of each panel of the first plurality of panels is attached to an upper portion of the front portion of the skirt at an intersecting area of the bodice and the front portion of the skirt;

the end of each panel of the second plurality of panels is attached to the upper portion of the rear portion of the skirt at the intersecting area of the bodice and the rear portion of the skirt;

the opposing end of each panel of the plurality of panels is unattached to the skirt;

each panel of the first plurality of panels extends downwardly from the intersecting area and over the front portion of the skirt and each panel of the second plurality of panels extends downwardly from the intersecting area and over the rear portion of the skirt to become part of the skirt in a first wearable configuration, which leaves the entirety of the bodice visible; and at least one panel of the first plurality of panels and at least one panel of the second plurality of panels are lifted in a direction above the intersecting area and are connected above the bodice extending over at least a portion of the bodice in a second wearable configuration.

2. The multi-use garment of claim 1, wherein the first plurality of panels is a plurality of front panels and wherein the second plurality of panels is a plurality of rear panels.

3. The multi-use garment of claim 1, wherein the bodice is a strapless bodice.

4. The multi-use garment of claim 3, wherein the strapless bodice comprises a neckline.

5. The multi-use garment of claim 4, wherein, in the second wearable configuration, the at least one panel of the first plurality of panels and the at least one panel of the second plurality of panels are lifted in the direction above the intersecting area and are connected above the bodice extending over the portion of the bodice and above the neckline of the bodice.

6. The multi-use garment of claim 1, wherein the at least one panel of the first plurality of panels and the at least one panel of the second plurality of panels are connected above the bodice in an area adapted to correspond to a neck of a user in the second wearable configuration, and wherein the at least one panel of the first plurality of panels and the at least one panel of the second plurality of panels are lifted in the direction above the intersecting area and are connected above the bodice in an area adapted to correspond to a shoulder of the user in a third wearable configuration.

7. The multi-use garment of claim 1, wherein a length of each of the plurality of panels from the attached end to the unattached end of the opposing end is similar to a length of the skirt.

8. The multi-use garment of claim 1, wherein, in the first configuration in which each panel of the first plurality of panels extends downwardly from the intersecting area and over the front portion of the skirt and each panel of the second plurality of panels extends downwardly from the intersecting area and over the rear portion of the skirt to become part of the skirt, at least a portion of the unattached end of the opposing end of each panel of the plurality of panels corresponds with a hem of the skirt.

9. The multi-use garment of claim 1, wherein each of the plurality of panels is pleated.

10. The multi-use garment of claim 1, wherein the bodice comprises integrated boning.

11. The multi-use garment of claim 1, wherein the bodice comprises inner bodice construction.

12. The multi-use garment of claim 1, further comprising a fastener that extends downwardly along a rear portion of the bodice and the rear portion of the skirt.

13. The multi-use garment of claim 1, further comprising a fastener that is positioned at a location along a midline of the multi-use garment, wherein the midline extends through the bodice and the skirt.

14. The multi-use garment of claim 1, wherein at least two of the plurality of panels are connected at the intersecting area in the second wearable configuration.

15. The multi-use garment of claim 1, wherein, in the second wearable configuration, the at least one panel of the first plurality of panels and the at least one panel of the second plurality of panels are connected above the bodice in an area corresponding to a front portion of the bodice.

16. The multi-use garment of claim 1, wherein a width of at least two panels of the plurality of panels corresponds to a length of a front portion of the intersecting area.

17. The multi-use garment of claim 1, further comprising a waist band attached to the skirt.

18. The multi-use garment of claim 1, wherein the skirt is a gathered skirt.

19. The multi-use garment of claim 1, wherein the skirt has an A-line shape.

20. The multi-use garment of claim 1, wherein the opposing unattached side of each panel has an endpoint and an opposing endpoint such that a first measured distance between a point on the attached side and the endpoint is shorter in length than a second measured distance between the point on the attached side and the opposing endpoint.

* * * * *